United States Patent [19]

Nystrand

[11] 3,943,605

[45] Mar. 16, 1976

[54] FLUFF ARTICLE AND METHOD AND APPARATUS FOR FORMING SAME

[75] Inventor: Ernst Daniel Nystrand, Green Bay, Wis.

[73] Assignee: Paper Converting Machine Company, Green Bay, Wis.

[22] Filed: May 16, 1974

[21] Appl. No.: 470,535

[52] U.S. Cl. ..... 19/145; 19/156.1; 19/156.3; 156/62.8; 264/113; 264/121

[51] Int. Cl.² ..... D01G 13/00

[58] Field of Search ..... 156/62.2, 62.8, 285, 62 X; 264/37, 91, 113, 121, 139; 425/81, 82, 83; 19/144.5, 156, 156.1, 156.3; 128/280 P, 286; 28/72.3

[56] References Cited

UNITED STATES PATENTS

| | | | |
|---|---|---|---|
| 2,086,757 | 7/1937 | Williams | 264/113 |
| 2,581,069 | 1/1952 | Bertolet, Jr. | 19/156.1 |
| 2,698,271 | 12/1954 | Clark | 264/113 |
| 2,743,758 | 5/1956 | Uschmann | 264/113 |
| 3,086,253 | 4/1963 | Joa | 264/121 |
| 3,515,609 | 6/1970 | Rudloff | 156/62.8 |
| 3,781,150 | 12/1973 | Matsumura et al. | 264/113 |

*Primary Examiner*—Douglas J. Drummond
*Assistant Examiner*—Michael W. Ball
*Attorney, Agent, or Firm*—Dawson, Tilton, Fallon & Lungmus

[57] ABSTRACT

A fluff pad for an absorbent product such as a diaper, sanitary napkin or the like is formed by superposing two layers of fluff top-to-top. The layers are formed separately but simultaneously on conveyor wires. The non-wire side of a layer is the "top". Each layer is scarffed and debulked. One layer is removed from its wire by suction and placed with its wire side engaging a wrap sheet traveling beneath the wire on which the second fluff layer is formed. The second layer is removed from its wire by applying suction from beneath, through the wrap sheet and first layer to deposit the second layer on the first in inverted relation. An additional dispersion sheet may be added between the fluff layers, if desired.

4 Claims, 9 Drawing Figures

FLUFF ARTICLE AND METHOD AND APPARATUS FOR FORMING SAME

BACKGROUND AND SUMMARY

Disposable absorbent products, particularly disposable diapers, have come into widespread usage. Such products conventionally have an absorbent or "fluff" layer sandwiched between a liquid impervious sheet (such as polyethylene) and a moisture pervious sheet (such as a non-woven cellulosic material). Methods and machines have been developed to produce these products at relatively good speeds. However, a limitation on speed increase has resided in the formation of the fluff layer. Many machines used for this purpose have employed a fluff forming drum, i.e., a cylindrical device of the general nature seen in U.S. Pat. No. 3,599,293. In such a system shredded cellulosic material is delivered under pressure into the interior of the drum and blown radially outwardly against a conveyor wire traveling about the periphery of the drum. The pressure causes a very dusty operation.

Through the practice of the invention, I have not only avoided the drawbacks of the prior art drum type of fluff former but at the same time have provided a fluff component for an absorbent product which has superior functional characteristics. According to the present invention, two layers of fluff are suction-formed simultaneously on wires advancing along inclined paths relative to their respective fluff housings. Herein, I use the term "wire" in the paper-making sense, having to do with a screen or foraminous type belt such as is found on a paper machine and called a Fourdrinier wire.

After the layers are formed, they are scarffed to a predetermined height and de-bulked. One fluff layer is removed from its wire under suction, and its bottom or "wire side" is brought into contact with a traveling wrap sheet. The wrap sheet and first fluff layer are then moved beneath the second fluff layer which is superposed on the first fluff layer with its top side contacting the top side of the first layer. This results in the wire sides of each layer being disposed outwardly of the combined layers; and the wire side of a fluff layer being denser, the resulting article has better dispersing qualities for body fluids. Further, the fine dust on the wire side is sucked out through the wire. Thus, the sandwich, or dual layer fluff component with the wire side disposed outwardly has the remaining dust trapped inside where it does not affect end use. Speed of operation is enhanced because forming a layer of one-half thickness takes much less time than forming a single layer of the desired thickness.

Persons skilled in the art will appreciate other features and advantages of the invention from the following detailed description, accompanied by the drawing.

THE DRAWING

Figure 7:
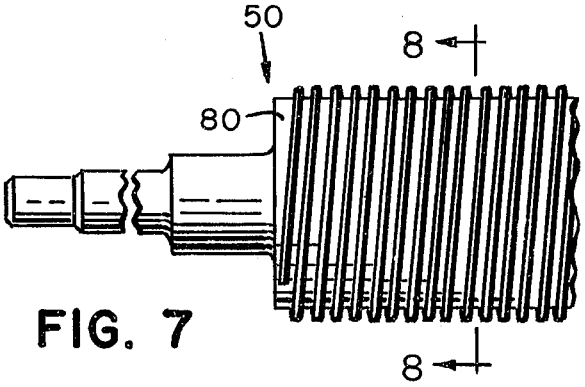
FIG. 7 is a fragmentary elevational view of a scarfing roll used in the invention.
Figure 8:
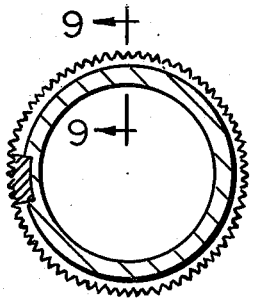
Figure 9:
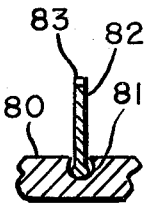

FIG. 8 is a cross section of the roll of FIG. 7, taken through the sight line 8—8; and FIG. 9 is a close-up view of a peripheral portion of the scarfing roll of FIGS. 7 and 8, taken through the sight line 9—9 of FIG. 8.

DETAILED DESCRIPTION

Figure 1:
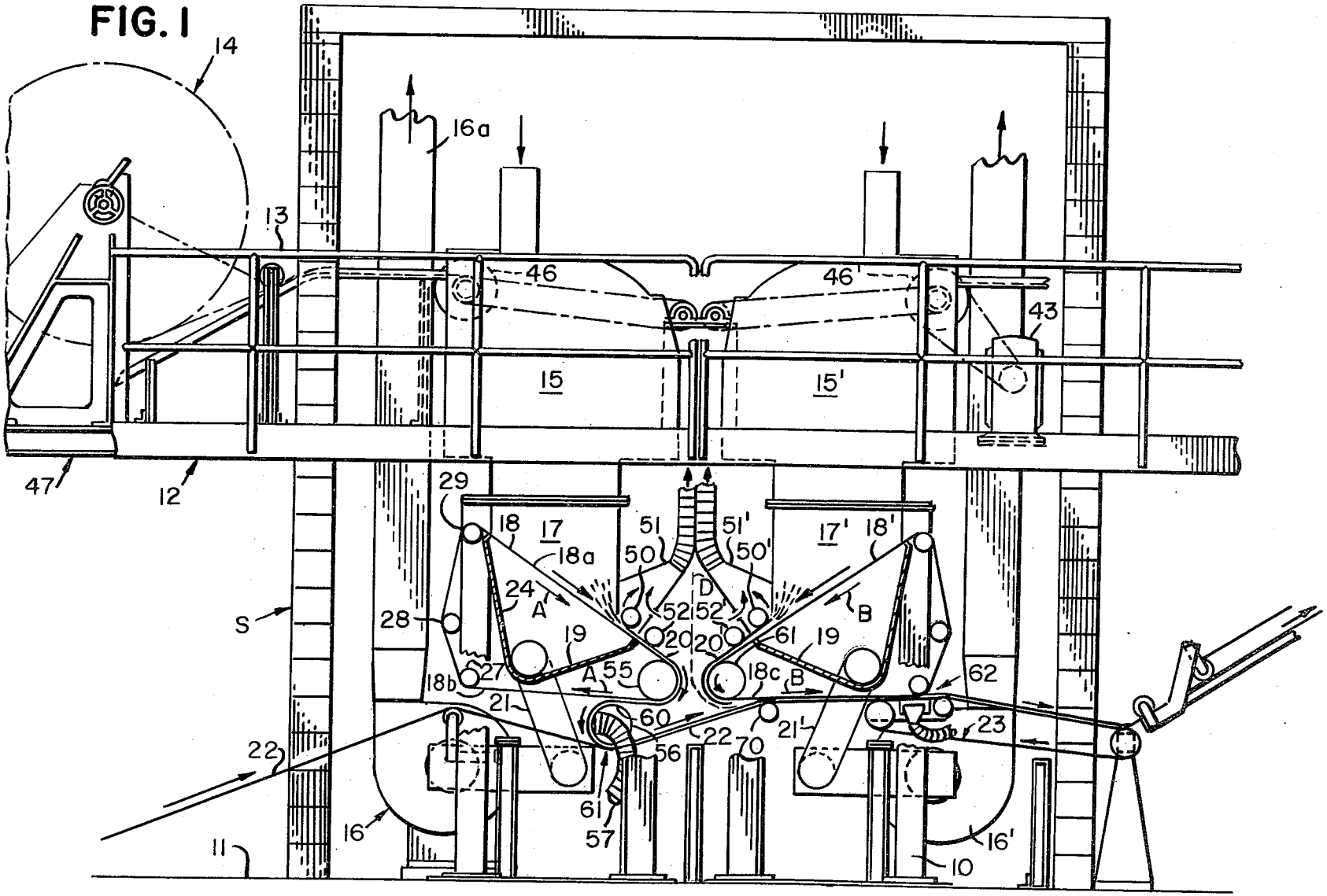
FIG. 1 is a side elevational view, partially broken away, of a portion of a diaper-making machine which includes a fluff-forming section incorporating the present invention, portions of the fluff-forming section being represented schematically.

Referring now to FIG. 1, reference numeral 10 (applied in the lower right-hand portion) designates generally a frame. It will be appreciated that the overall diaper-making machine may be several hundred feet in length and the part illustrated in FIG. 1 can occupy two stories. For example, the numeral 11 designates the floor while the numeral 12 designates a second level, viz., a catwalk complete with railing 13. However, only that portion of the overall machine relating to forming the double-layer fluff pad is disclosed herein since conventional machines may be used to complete the product by applying the non-woven, applying adhesive, cutting, etc. The present invention may be fully understood without such subsequent operations, and it may be used in any number of end products, each employing its own processes for forming the end product—thus, the present invention relates to the fluff pad and its formation and is independent of the configuration of the resultant article in which it is used, although its advantageous characteristics will be retained.

In general operation, a parent roll 14 (see the upper left-hand corner of FIG. 1) delivers a web of pulp or other fluff-forming material to a first hammermill 15. The hammermill 15 takes the pulp web and shreds it, as is shown, and delivers it downwardly through a plenum or box 17 onto an endless wire 18 traveling in the direction of arrows A. Suction is applied beneath the downwardly inclined run 18a of wire 18 as it passes beneath plenum 17 by means of a suction box 19, resulting in a first fluff layer 20 deposited on wire 18. The suction box 19 (shown in cross section) is coupled by means of a conduit 21 to the inlet of a blower 16 which creates the vacuum. The blower 16 forces any material passing through wire 18 into filters or air cleaners (not shown) via conduit **16*a*. As the fluff mat or pad exits from beneath the plenum 17 carried by the belt 18, it is scarffed by means of a roll 50 housed within a chamber 51. Scarfing brings the pad to a predetermined height which is uniform across its width. As the fluff mat exits the housing 51, it is debulked (that is, pressed) by means of a roll 52. There results a continuous fluff mat or web indicated by the heavy line 20 carried by the wire 18**. The apparatus just disclosed, except for the parent rolls, is enclosed within a structure, schematically shown at S, for sound insulation and humidity control. Best results are obtained in the finished product if the relative humidity is kept at approximately 70 per cent.

Thus far, reference has been made only to the left side of FIG. 1 which constitutes one side of the fluff-forming unit. It will be appreciated that a substantially identical arrangement is provided on the right-hand side. The corresponding parent roll of pulp has been omitted for clarity. The right-hand unit includes a hammermill 15' feeding a plenum 17' delivering fluff elements to a second endless wire 18' traveling in the direction of arrows B. The wire 18' has its associated suction box 19' coupled to the inlet of a second blower 16' through a conduit 21'. As the second fluff mat exits the plenum 17', it, too, is subjected to scarfing by a roll 50' located within a housing 51'; and after the mat exits the housing 51' is debulked by means of a roll 52' thereby resulting in a continuous mat of uniform height, designated 20'.

Figure 2:
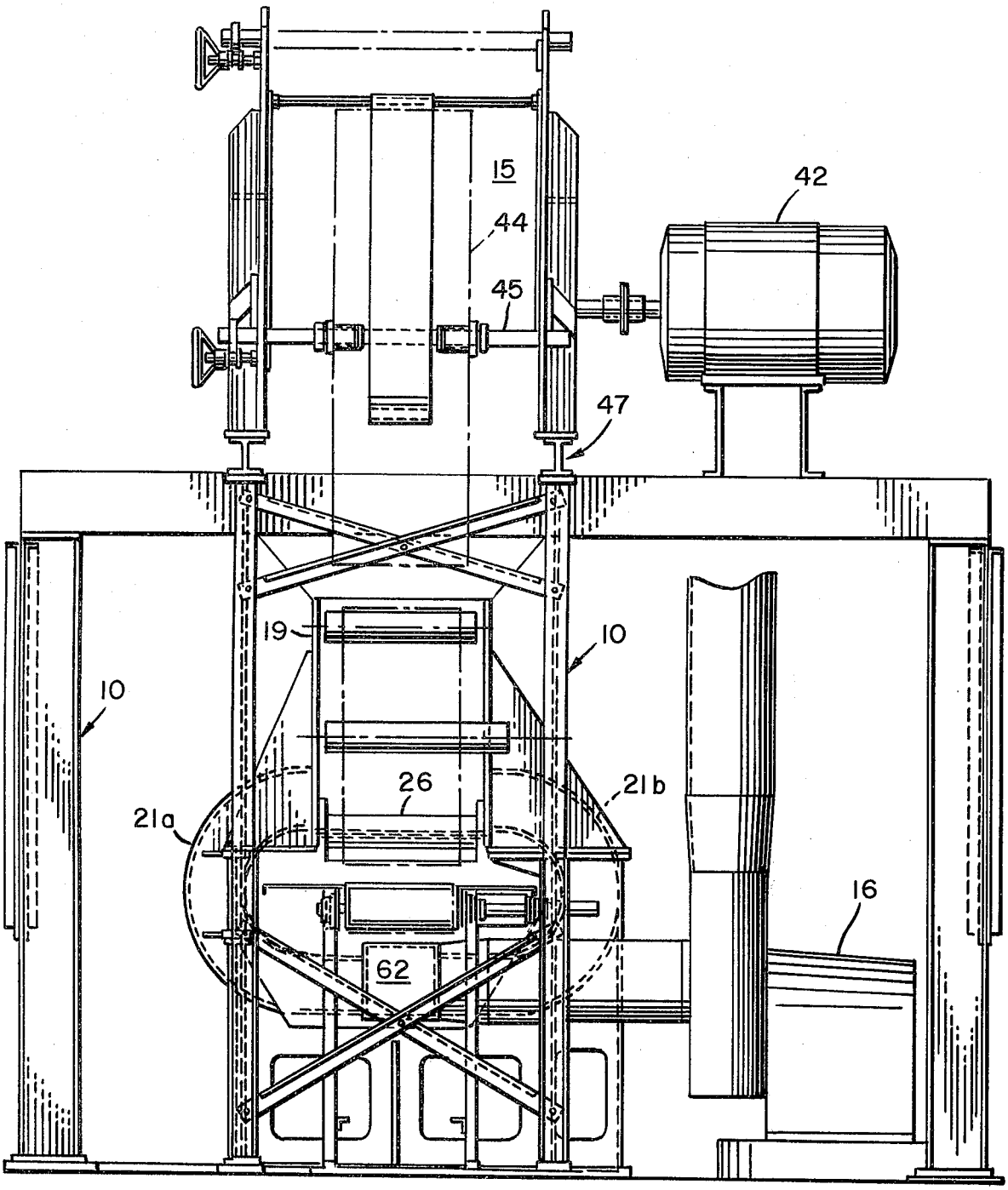
FIG. 2 is an end view of the fluff-forming section of the diaper machine of FIG. 1.

Each hammermill is driven by its own motor. FIG. 2 shows hammermill 15 driven by a motor 42. A variable speed system 43 from the main drive, not shown, drives draw rolls 46 and 46' to feed the pulp into the hammermills.

The dashed outline 44 represents the position of an 18'' wide parent roll of pulp which is suitably journaled on shaft 45 as part of an unwind stand 47. (See also upper left-hand corner of FIG. 1.)

The first fluff layer 20 (FIG. 1) travels with the wire 18 about a driven roll 55 and along a bottom run 18b a short distance, and it is then removed from the belt 18 by a vacuum roll 56 which is coupled by means of a conduit 57 to the inlet of the blower 16 to create suction. The vacuum roll 56 is of the type having an apertured rotating cylinder to which vacuum is applied only over a preselected angular portion. Such cylinders are well-known in the art, and in the present invention, the vacuum section is defined by a first blocking plate extending axially of the cylinder and located at the uppermost position indicated by reference numeral 60. The vacuum is released at approximately the location indicated by a reference numeral 61 where the mat 20 is deposited on a traveling wrap sheet or carrier web designated 22.

The wrap sheet 22 and the first mat 20 then pass beneath the lower run **18*c* of the right side wire 18'. It will be observed that the right side fluff mat 20' is moved around a roll 61 so that it is inverted. Thus, the "top" of the mat 20' engages the "top" of the mat 20; and the wrap sheet 22, lower mat 20, and upper, inverted mat 20' travel in engagement toward the right side of the drawing over a vacuum station generally designated by reference numeral 62.**

At the station 62, vacuum is applied through the bottom of the wrap sheet 22 and the fluff layer 20 to remove the upper fluff layer 20' from the belt 18', thereby forming a double-layer fluff mat with the "wire sides" or "bottoms" of the individual layers facing outwardly, one of them being supported on a wrap sheet for subsequent processing. Toward this end, the wrap sheet 22 is supported on a conveyor generally designated 23 toward the lower right-hand portion of FIG. 1.

DESCRIPTION OF STRUCTURE

Referring now particularly to the left side of FIG. 1 in the apparatus for forming the first fluff layer 20, it will be observed that the suction box 19 has a generally triangular shape in side section, including a generally L-shaped lower wall 24. It also includes a perforated inclined wall (not shown) for supporting the wire 18 and connected between the distal ends of the L-shaped housing 24. It will be observed that the angle of inclination of the inner section between the plenum 17 and the suction box 19 which defines the upper run **18*a* of the belt 18 is inclined downwardly at approximately a 45° angle. This has been found advantageous in that for a given width of plenum 17, the distance over which the fluff is deposited on the wire 18 is greater than if the wire were horizontal, yet gravity is used, together with the vacuum, in depositing the fluff (which would not occur if the belt were vertical). It will be observed that a similar diagonal run is included between the right side plenum 17' and the right suction box 19'**.

The wire 18 is entrained about the driven roll 55 together with three idler rolls designated respectively 27, 28 and 29.

Figure 3:
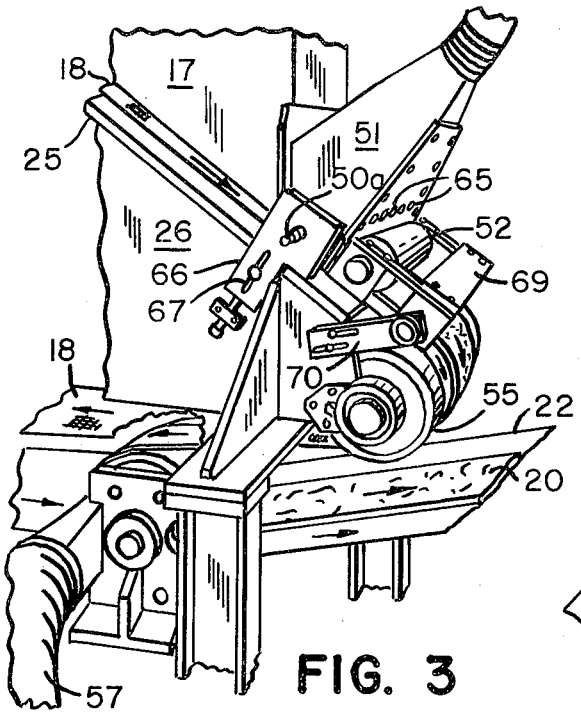
FIG. 3 is a fragmentary perspective view of the left-side fluff-forming section for making the first or lower fluff layer.
Figure 5:
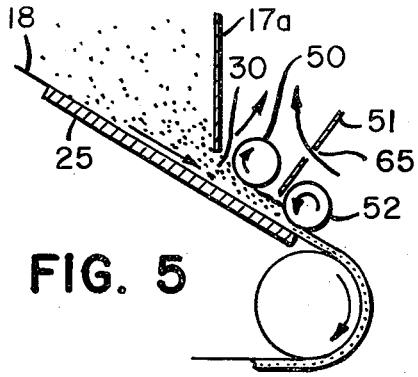
FIG. 5 is a diagrammatic view of the output end of a fluff-forming section showing scarfing and debulking of a fluff layer.

Turning now to FIGS. 3 and 5, the upper, inclined, perforated wall of the suction box is designated 25, only the peripheral, non-perforated portion being seen. It will be seen that the suction box 19 also includes enclosing side walls, one of which is seen in FIG. 3 and designated 26. The width of the perforated area on the wire support wall 25 defines the final width of the fluff layers being formed; and one of the resulting advantages is the facility with which the width of the product may be varied.

As best seen in FIG. 5, the plenum 17 includes a forward wall **17*a*, the lower portion of which terminates at a fixed distance above the web 18 to form a mouth or exit aperture 30. The scarfing roll 50 is driven in a direction of rotation that is clockwise so that the scarfing surface is moving counter to the movement of the fluff mat as it exits from the mouth 30. The material that is taken off the top of the fluff mat by the scarfing roll 50 is mixed with air forced in through apertures 65 on the housing 51 and coupled back into the hammermill 15.**

As seen in FIG. 3, a shaft 50a which carries the scarfing roll 50 is journaled in a plate 66 which is adjustably mounted to the side wall 26 by means of an elongated slot 67. A similar arrangement on the other side permits adjustment of a scarfing roll relative to the wire 18 so as to adjust the height or thickness of the fluff layer being formed.

Immediately downstream of the vacuum hosuing 51 is the debulking roll 52 which is rotatably mounted on a frame 69 which, in turn, is mounted on a pair of arms, one of which is shown at 70 and held in place by friction. The weight of the roll 52 together with its friction mounting causes the compression and debulking of the moving fluff mat.

Figure 4:
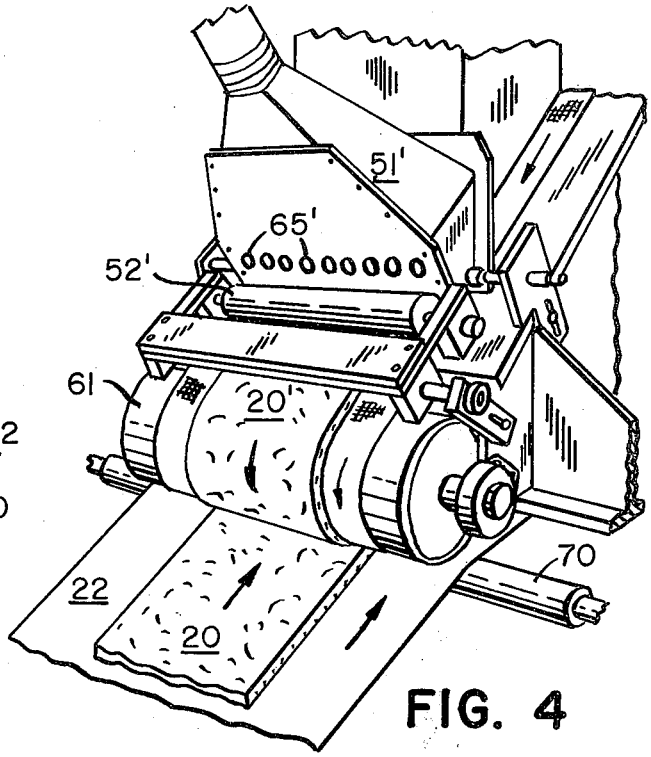
FIG. 4 is a fragmentary perspective view of the fluff-forming section for the right side or upper layer.
Figure 6:
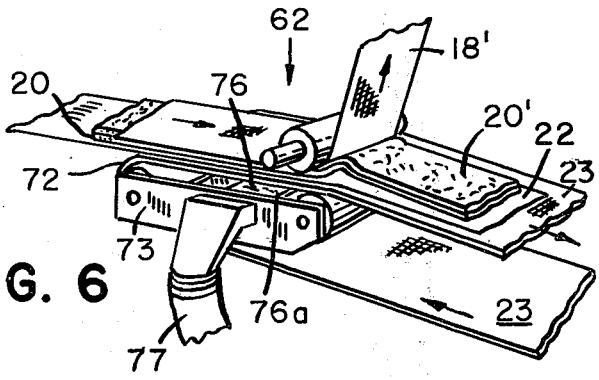
FIG. 6 is a fragmentary perspective view showing the vacuum removal of the second or upper fluff layer.

A similar arrangement for the right side scarfing vacuum housing 51' (including apertures 65') and debulking roll 52' is seen in FIG. 4 from left perspective. As seen there, the wrap sheet 22 travels over a stationary rod support 70 which is spaced slightly from the driven roll 61 such that the top of the lower fluff layer 20 is brought into contact with the similar top side (now inverted) of the upper fluff layer 20'. The two fluff layers, in superposed relation, together with the wrap sheet 22, then move to the second vacuum removal station 62, as seen in FIG. 6. The conveyor 23 is trained about an idler roll 72 journaled in a frame 73. The frame 73 also carries a box 76 having an upper perforated cover 76a over which the upper run of the conveyor 23 passes, contacting it. Vacuum is applied to the box 76 by means of a conduit 77 coupled back to the blower 16'. Thus, vacuum is applied through the conveyor 23, the wrap sheet 22, and the lower fluff layer 20 to remove the upper fluff layer 20' from the wire 18'. The use of vacuum to remove the fluff mats from their associated forming wires has been found quite effective, although equivalent means may equally well be employed. Further, depending upon the coarseness of the fluff and the mesh sides of the forming wires, it may be possible to eliminate all mechanical assistance for removing the fluff mats from their forming wires.

Turning now to FIGS. 7–9, the scarfing roll 50 (which is identical to the scarfing roll 50') is shown in greater detail as including a cylindrical central portion 80 into which is formed two helical grooves, one of which is shown at FIG. 9 in cross section. A flat wire 82 having a serrated or saw-tooth scarfing edge 83 is peened into each of the spiral grooves, thereby forming a double lead scarfing roll with overlapping of the individual helical wires. The scarfing roll is preferably of hollow construction and as light a weight as possible so that the cylindrical portion 80 is supported only at the ends.

In the operation of the invention, air is drawn by the blowers 16 and 16' respectively into the hammermills 15 and 15', thereby creating a downflow of shredded pulp or like cellulosic material within the plenums 17 and 17'. The fluff fibers or particles are intercepted by the wires 18 and 18', the impingement being amplified by the suction applied to the underside of the upper run of each wire 18 and 18' by the respective suction boxes 19 and 19'. Since the most dense uniform surface of a fluff layer is formed next to the wire, the dual system here presented produces a superior fluff sandwich, i.e., one with the wire sides disposed outwardly, i.e., top and bottom. As pointed out previously, this reduces the amount of objectionable fine dust on the surface and enhances the product by having a high dispersion surface on both sides of the product. The remaining dust is trapped interiorily of the two layers 20 and 20'.

Also through the invention, speed is increased because the time of forming a half thickness fluff layer is less than forming the full thickness layer. The convergent paths of travel of the wires 18 and 18' during the time of fluff formation is helpful in increasing the speed potentials. Arranging the angles of travel at about 45° as shown, the forming distance is increased over 40 per cent—as contrasted to formation in a plane parallel with the path of travel of the carrier web 22. Further, the invention has the advantage that one fluff mat may be of a different base material than the other and the second fluff mat may be narrower than the other if deemed advantageous. Still further a dispersion sheet (schmeatically represented by D in the center of FIG. 1) may be added between the two mats.

A wide range of materials may be used in the present invention, particularly in the pulp materis. For example, pulp materials of Weyerhauser designated NBF and SAD are equally well employed, depending upon the desired characteristics of the end product. One of the features of the present invention is the broad range of pulp materials with which it may be used.

If it is desired to increase the thickness of the fluff layers, the height of the scarfing roll and debulking roll are adjusted and the feed rate of the pulp is increased by varying the drive 43. If very thick pads are desired, the pulp webs may be fed at double thickness.

The forming wires 18 and 18', as mentioned, are of construction similar to conventional Fourdrinier wire. For example, although the invention is not so limited, a plastic monofilament wire having a No. 44 mesh, that is, 44 wires of seven-mil monofilament per inch may be used, although metallic wires may also be used.

The wrap sheet may be any air pervious material; and this is considered another important feature of the present invention—namely that the porosity of the wrap sheet need not be critically controlled because the fluff mat is not formed on the wrap sheet, but on the forming wire. In some previous machines, where the fluff mat is formed directly on a wrap sheet or carrier web which goes into the product, the porosity of the carrier web had to be controlled rather closely, thereby adding to the expense of the end product. The present invention, by forming the fluff mat on a forming wire and then depositing it on a wrap sheet, as seen in FIG. 3, avoids this problem yet has the advantages of the dispersion properties of a wrap sheet together with the stability that it adds in subsequent product processing. The fluff may be 20 to 30 grams per square foot in the two-layer finished mat—that is, 10 to 15 grams per square foot per layer.

The dispersion properties of the finished product mentioned above, are also enhanced by having the "wire side" of each fluff layer forming the outer surfaces of the combined double-layer fluff mat. In the wire sides of each fluff layer, the fibers tend to be more closely interlocked mechanically and provide a denser surface, free of dust, which provides a greater wicking, and thence lateral dispersion characteristic.

Having thus described in detail one embodiment of a system and method for forming a double-layer fluff mat, persons skilled in the art will be able to modify certain of the steps which have been disclosed and to substitute equivalent elements for those illustrated while continuing to practice the principle of the invention, and it is, therefore, intended that all such modifications and substitutions be covered as they are embraced within the spirit and scope of the appended claims.

I claim:

1. In a method of forming fluff for an absorbent product, the steps of simultaneously advancing first and second continuous wires respectively along first and second paths, each path providing a fluff-forming section therealong, said fluff-forming sections being inclined relative to the horizontal; depositing fluff downwardly onto the top of each of said wires adjacent said fluff-forming sections while creating a vacuum beneath said wires adjacent said fluff-forming section, thereby to form first and second continuous layers of fluff respectively on the top of said first and second wires; removing said first layer of fluff from said first wire and continuously depositing it on an advancing wrap sheet with the wire side of said first fluff layer contacting said wrap sheet; then bringing said first fluff layer adjacent said second fluff layer while the latter is still on its forming wire with the wire sides of said respective fluff layers facing outwardly; and then applying a vacuum through said wrap sheet and said first fluff layers to remove said second fluff layer from its associated forming wire at a location remote from the fluff-forming section of said second wire.

2. The method of claim 1 wherein said fluff-forming sections are angularly disposed at angles of about 45° with the horizontal and converge toward each other.

3. The method of claim 1 wherein said step of removing said first layer from said first wire comprises applying a vacuum to the top side of said fluff layer after forming to remove the same from its associated wire.

4. The method of claim 1 further comprising the steps of scarfing each of said layers as it exits from its associated forming section; and thereafter debulking each of said layers.

* * * * *